US011486569B2

(12) United States Patent
Chen et al.

(10) Patent No.: US 11,486,569 B2
(45) Date of Patent: Nov. 1, 2022

(54) LIGHT SOURCE MODULE AND APPLIED ILLUMINATING DEVICE THEREOF

(71) Applicants: SHANGHAI SANSI ELECTRONIC ENGINEERING CO. LTD., Shanghai (CN); SANSI OPTOELECTRONICS TECHNOLOGY (SHANGHAI) CO. LTD., Shanghai (CN); SHANGHAI SANSI TECHNOLOGY CO. LTD., Shanghai (CN); JIASHAN SANSI OPTOELECTRONIC TECHNOLOGY CO. LTD., Zhejiang (CN)

(72) Inventors: Bishou Chen, Shanghai (CN); Peng Wang, Shanghai (CN); Xiaoliang He, Shanghai (CN); Li Xu, Shanghai (CN)

( * ) Notice: Subject to any disclaimer, the term of this patent is extended or adjusted under 35 U.S.C. 154(b) by 145 days.

(21) Appl. No.: 16/066,532

(22) PCT Filed: Oct. 27, 2017

(86) PCT No.: PCT/CN2017/107938
§ 371 (c)(1),
(2) Date: Apr. 26, 2021

(87) PCT Pub. No.: WO2019/047344
PCT Pub. Date: Mar. 14, 2019

(65) Prior Publication Data
US 2021/0247061 A1 Aug. 12, 2021

(51) Int. Cl.
*F21V 29/83* (2015.01)
*F21S 2/00* (2016.01)
(Continued)

(52) U.S. Cl.
CPC ..... *F21V 29/83* (2015.01); *F21K 9/20* (2016.08); *F21S 2/005* (2013.01); *F21S 8/038* (2013.01);
(Continued)

(58) Field of Classification Search
CPC ..... F21V 29/83; F21V 31/005; F21V 5/04; F21V 17/005; F21V 17/164; F21V 23/06; F21S 2/005; F21S 8/038; F21K 9/20
See application file for complete search history.

(56) References Cited

U.S. PATENT DOCUMENTS

2009/0268468 A1* 10/2009 Liu ..... F21V 29/75 362/294

FOREIGN PATENT DOCUMENTS

CN 201310855 Y * 9/2009 ..... F21K 9/00
CN 204062599 U * 12/2014 ..... F21S 2/00
(Continued)

*Primary Examiner* — Alan B Cariaso
(74) *Attorney, Agent, or Firm* — Global IP Services; Tianhua Gu

(57) ABSTRACT

The present disclosure provides a light source module and a lighting device using the same. The light source module includes: a support member, to be disposed on a lighting device and provided with a first positioning portion; a light source mounting member, having a second positioning portion to be jointed with the first positioning portion through shape matching, where the light source mounting member has a bearing surface for disposing a light source electronic component; and a lens member, covering the bearing surface and connected to the support member in a positioned manner.

21 Claims, 11 Drawing Sheets

(51) Int. Cl.

| | |
|---|---|
| ***F21S 8/00*** | (2006.01) |
| ***F21V 17/16*** | (2006.01) |
| ***F21V 31/00*** | (2006.01) |
| ***F21K 9/20*** | (2016.01) |
| ***F21V 17/00*** | (2006.01) |
| ***F21V 5/04*** | (2006.01) |
| *F21Y 115/10* | (2016.01) |

(52) U.S. Cl.
CPC ..... *F21V 5/04* (2013.01); *F21V 17/005* (2013.01); *F21V 17/164* (2013.01); *F21V 31/005* (2013.01); *F21Y 2115/10* (2016.08)

(56) References Cited

FOREIGN PATENT DOCUMENTS

| | | | | | | |
|---|---|---|---|---|---|---|
| KR | 20100007333 | A | * | 1/2010 | ..... | F21V 29/74 |
| KR | 20100005008 | U | * | 5/2010 | ..... | F21V 29/89 |
| WO | WO-2011040671 | A | * | 4/2011 | ..... | F21K 9/00 |

* cited by examiner

LIGHT SOURCE MODULE AND APPLIED ILLUMINATING DEVICE THEREOF

CROSS REFERENCE TO RELATED PATENT APPLICATION

The present application is the US national stage of PCT/CN2017/107938 filed on Oct. 27, 2017, which claims the priorities of the CN2017211331740 filed on Sep. 5, 2017 and CN2017107921862 filed on Sep. 5, 2017, which applications are incorporated herein by reference.

BACKGROUND OF THE PRESENT INVENTION

Field of Invention

The present application relates to the technical field of lighting, and in particular, to a light source module and a lighting device using the same.

Description of Related Arts

Current lighting devices generally use LED light sources. Cooling and modular design need to be considered during the design of the LED light sources. However, in current lighting devices, LED light source circuit modules generally have a one-piece structure. When one of light source chips is damaged, the whole LED light source circuit needs to be replaced, which will result in high cost; moreover, the disassembly and replacement of light source circuit are inconvenient, thereby affecting maintenance efficiency. As for cooling, in a common lamp structure, an LED chip is packaged on a circuit board, and then the circuit board is brought into contact with a cooling structure for cooling. In such a manner, the cooling efficiency is low, service life and luminous efficiency of LEDs will be affected. The applicant disclosed a cellular lamp in Chinese Patent No. ZL200810204172.5, in which light source of the lamp is designed to have a plurality of sub-modules with independent cooling structures, and the entire lamp is designed to be transparent. As such, the cooling efficiency is significantly improved, so that the lamp has obvious advantages in terms of service life, quality, and reliability compared with conventional LED lamps. The cellular lamp is widely applied in highway and tunnel lighting. However, the cellular lamp has high cost and is complex for assembling and manufacturing processes. How to optimize the structure and reduce the cost is the research direction of the applicant.

SUMMARY OF THE PRESENT INVENTION

In view of the foregoing disadvantages of the prior art, an object of the present application is to provide a light source module and a lighting device using the same, so as to resolve the problems in the prior art.

In order to accomplish the above and other related objects, the present application provides a light source module, comprising: a support member, disposed on a lighting device and provided with a first positioning portion; a light source mounting member, provided with a second positioning portion jointed with the first positioning portion through shape matching, where the light source mounting member has a bearing surface for disposing a light source electronic component; and a lens member, covering the bearing surface and connected to the support member in a positioned manner.

In an embodiment of the present application, the light source module comprises at least one pair of electrode components, one end of electrode component is electrically connected to the light source electronic component and the other end passes through the support member and the light source mounting member to be exposed.

In an embodiment of the present application, the electrode component and the light source electronic component are connected through a printed circuit.

In an embodiment of the present application, the light source mounting member is made of ceramic.

In an embodiment of the present application, at least part surface of the light source mounting member is wrinkled.

In an embodiment of the present application, the bearing surface is provided with an annular groove around the light source electronic component; the lens member has an annular flange jointed with the annular groove, so as to form, together with the bearing surface, a closed space for containing the light source electronic component; and a sealant is disposed in the annular groove to seal the closed space.

In an embodiment of the present application, the support member is provided with at least one first extension portion around the first positioning portion, the at least one first extension portion extending towards the lens member, and the light source mounting member is provided with at least one limiting portion, the at least one limiting portion each is jointed with one of the at least one first extension portion correspondingly. In an embodiment of the present application, the first extension portion is a convex body extending towards the lens member, and the limiting portion is a groove located on an outer surface of the light source mounting member and fitting with the convex body.

In an embodiment of the present application, the limiting portion is a groove; the light source mounting member comprises: a main body; and at least two protruding structures disposed with spacing along the circumference of a lateral side of the main body, where the limiting portion is formed at a gap between the protruding structures.

In an embodiment of the present application, the at least two protruding structures each have a through portion serving as a cooling air flow passage.

In an embodiment of the present application, the lens member is provided with a second extension portion jointed with the limiting portion, the first extension portion and the second extension portion are each jointed with a part of the limiting portion.

In an embodiment of the present application, the positioning connection is a clamping connection; the support member is provided with a first clamping portion; and the lens member is provided with a second clamping portion clamped with the first clamping portion.

In an embodiment of the present application, the first clamping portion is disposed at the first extension portion, and the second clamping portion is disposed at the second extension portion.

In an embodiment of the present application, the first clamping portion is one of a hook portion and a buckle portion clamped with the hook portion, the second clamping portion is the other one of the hook portion and the buckle portion.

In an embodiment of the present application, a clamping manner between the first clamping portion and the second clamping portion is either of the following: 1) the first clamping portion is a hook portion located on the circumference of the support member and protruding outwards to clamp with the second clamping portion on an external side thereof; and 2) the first clamping portion comprises a hook portion located on the circumference of the support member and protruding inwards and a stopping portion disposed opposite to the hook portion, where a gap is formed between the hook portion and the stopping portion to allow the buckle portion to insert and clamp with the hook portion; and the gap has an adjustable width to limit the buckle portion within the gap.

In an embodiment of the present application, a concave-convex fitting structure is formed between the first positioning portion and the second positioning portion.

In order to accomplish the above and other related objects, the present application provides a lighting device, comprising one or more light source modules described above.

In an embodiment of the present application, the lighting device comprises a bearing member, where the support member is provided with a third positioning portion; and the bearing member is provided with a fourth positioning portion jointed with the third positioning portion through shape matching.

In an embodiment of the present application, the third positioning portion is one of a shaft hole and a shaft portion that can be jointed in a rotatable manner, and the fourth positioning portion is the other one of the shaft hole and the shaft portion; the bearing member is provided with one or more first rotation limiting portions along the circumference of the third positioning portion; a guide structure and a barrier structure disposed along the circumference of the first rotation limiting portion are formed on the surface of the first rotation limiting portion; the support member is provided with one or more second rotation limiting portions around the circumference of the fourth positioning portion, where the one or more second rotation limiting portions each corresponds to each of the one or more first rotation limiting portions; when the third positioning portion is jointed with the fourth positioning portion, rotation of the third positioning portion with respect to the fourth positioning portion causes the second rotation limiting portion to move along the guide structure of the corresponding first rotation limiting portion, until the second rotation limiting portion reaches the barrier structure of the first rotation limiting portion, blocked by the barrier structure, and rotates reversely.

In an embodiment of the present application, the first rotation limiting portion is a lobe, and the second rotation limiting portion is a convex portion.

In an embodiment of the present application, the third positioning portion is provided with a third rotation limiting portion on the circumference of a lateral side, and the fourth positioning portion is provided with a fourth rotation limiting portion on the circumference of a lateral side; when the second rotation limiting portion reaches the barrier structure of the first rotation limiting portion, the third rotation limiting portion is blocked by the fourth rotation limiting portion, so that further rotation of the third positioning portion is restricted.

In an embodiment of the present application, the third rotation limiting portion is a convex portion, the fourth rotation limiting portion is an open slot open towards the convex portion, and edges of the open slot are used to block the third rotation limiting portion.

In an embodiment of the present application, a concave-convex fitting is formed between the third positioning portion and the fourth positioning portion.

As described above, the present application provides a light source module and a lighting device using the same. The light source module comprises: a support member, to be disposed on a lighting device and provided with a first positioning portion; a light source mounting member, having a second positioning portion to be jointed with the first positioning portion through shape matching, where the light source mounting member has a bearing surface for disposing a light source electronic component; and a lens member, covering the bearing surface and connected to the support member in a positioned manner. A light source of each lighting device can comprise one or more light source modules consistent with the present application, and each light source module is an independent component that is easy to replace, thereby resolving problems in the prior art. Moreover, the support member and the light source mounting member are independent components; the support member and the light source mounting member may be made of different materials, thereby helping reduce costs.

DESCRIPTIONS OF REFERENCE NUMERALS

Figure 1A:
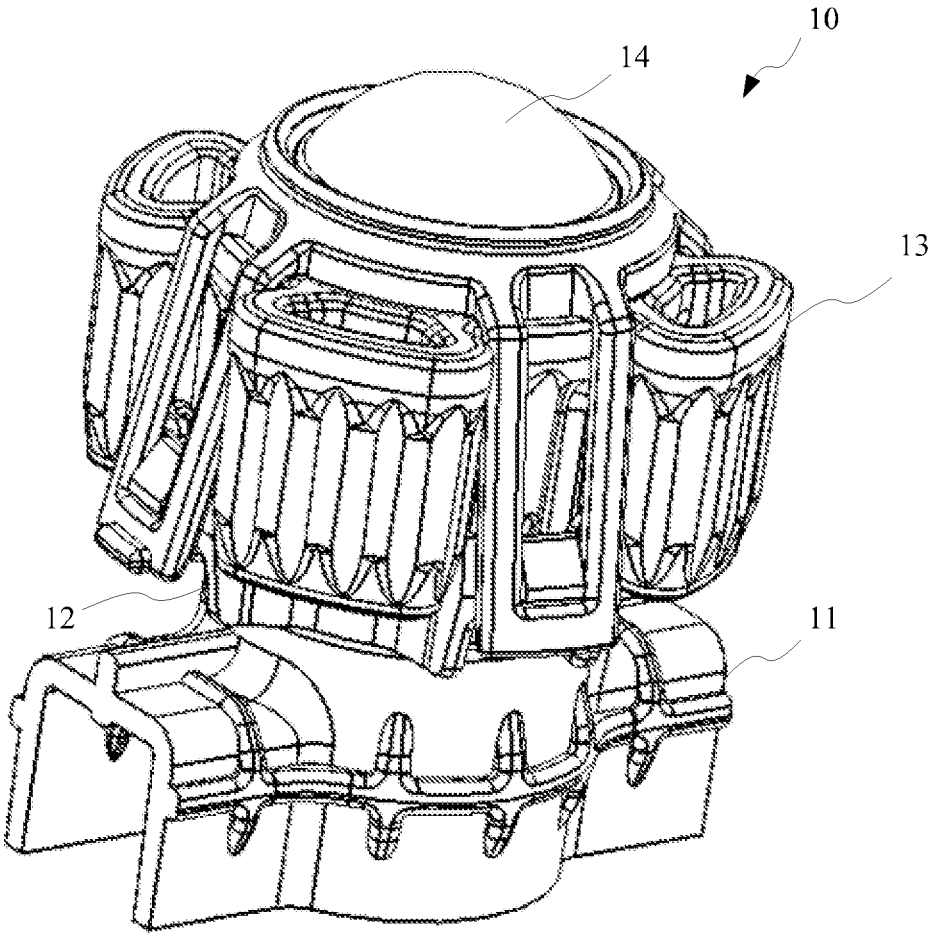
FIG. 1A is an assembled schematic diagram of a light source module in an embodiment of the present disclosure.

10 Light source module
11 Bearing member
111 Third positioning portion
112 Second extension portion
113 Notch
114 First rotation limiting portion
1141 Guide structure
1142 Barrier structure
12 Support member
121 Fourth positioning portion
122 Second rotation limiting portion
123 First positioning portion
1231 Notch
124 First extension portion
125 First clamping portion
126 Fourth rotation limiting portion
127 Second through-hole

13 Light source mounting member
131 Main body
1311 Second positioning portion
1312 Boss
132 Protruding structure
1321 Through portion
133 Limiting portion
134 Wrinkles
135 First through hole
136 Annular groove
14 Lens member
141 Second extension portion
142 Second clamping portion
143 Annular flange
15 Light source electronic component
16 Electrode component
22 Support member
225 First clamping portion
2251 Hook portion
2252 Stopping portion
24 Lens member
242 Second clamping portion

DETAILED DESCRIPTION OF THE PREFERRED EMBODIMENTS

Implementations of the present invention are illustrated below through specific embodiments. Those skilled in the art can easily understand other advantages and efficacy of the present invention according to the content disclosed in this specification.

Refer to the accompanying drawings of the specification of the present invention. It should be noted that the structures, scales, sizes and the like drawn in the accompanying drawings of this specification are all merely used to cooperate with the content disclosed in the specification so as to help those skilled in the art understand and read the content, but are not used to define limiting conditions for implementing the present invention and therefore do not have any substantial technical meanings. Any modifications on the structures, changes in the scale relations or adjustment in the sizes that do not affect the efficacy and objects of the present invention should still fall within the scope covered by the technical content disclosed by the present invention. Meanwhile, terms such as "upper", "lower", "left", "right", "middle" and "one" mentioned in this specification are merely used for the clarity of the description, and are not intended to limit the implementation scope of the present invention. Changes or adjustments in relative relations thereof without changing the technical content substantially should also be considered as the implementation scope of the present invention.

The present disclosure is applied to the technical field of lighting, and provides a design of a light source module. The light source module can be applied to various lighting devices, for example military or civil lamps such as household lamps or public facility lamps.

Figure 1B:
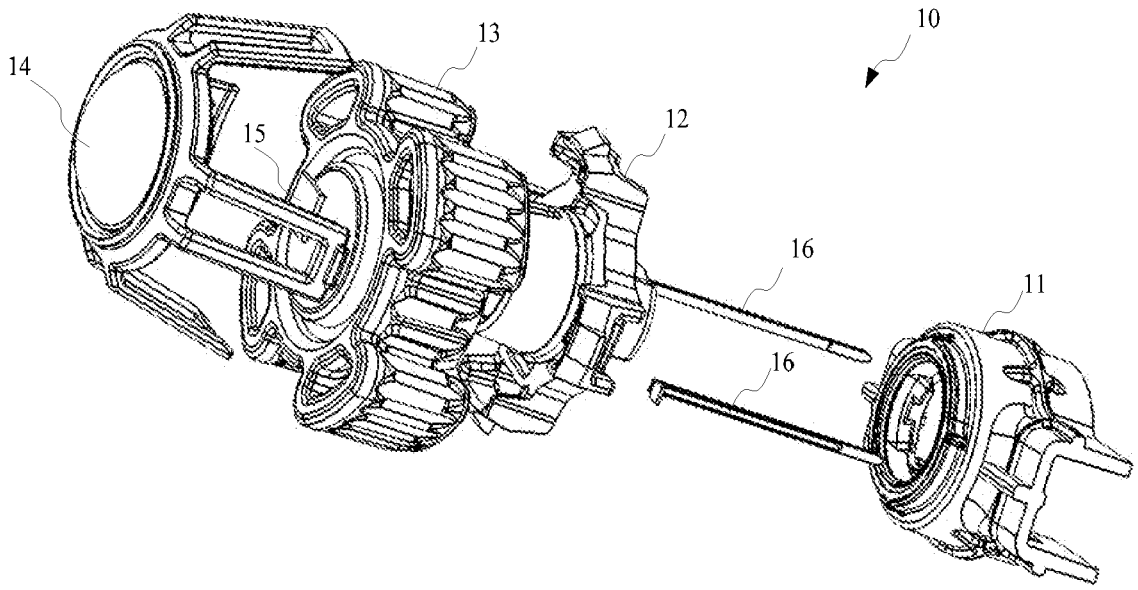
FIG. 1B is an exploded schematic diagram of a light source module in an embodiment of the present disclosure.

Referring to FIG. 1A and FIG. 1B, FIG. 1A and FIG. 1B show an assembled structure and an exploded structure of a light source module 10 in an embodiment of the present disclosure. The light source module 10 is disposed on a bearing member 11. The bearing member 11 may be an independent component fixedly disposed on a lighting device (such as a lamp, which is not shown in the figures). In other embodiments, the bearing member 11 may also be a part of an integrated housing of the lighting device. In other embodiments, the bearing member 11 may be integrated with one or more light source modules 10 to form one component.

As shown in the figures, in this embodiment, the light source module 10 includes: a support member 12, a light source mounting member 13, and a lens member 14.

As shown in the figures, in this embodiment, the bearing member 11, the support member 12, the light source mounting member 13, and the lens member 14 are arranged one by one from the bottom to the top and assembled with each other, and the components may be coaxially disposed.

Figure 2A:
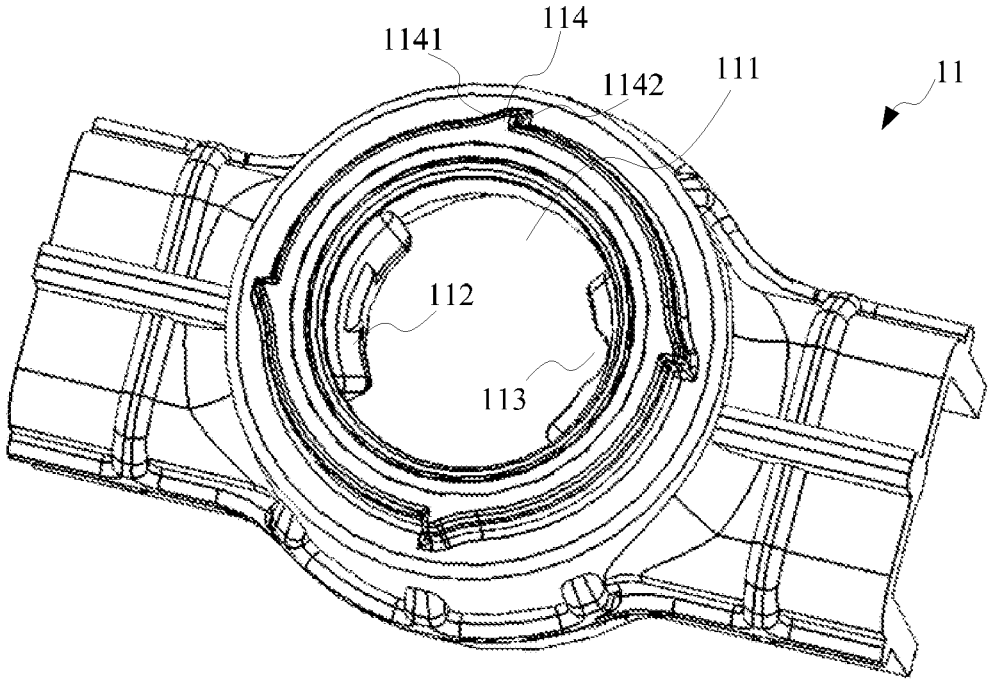
FIG. 2A and FIG. 2B are schematic diagrams of a bearing member from different views in an embodiment of the present disclosure.
Figure 3A:
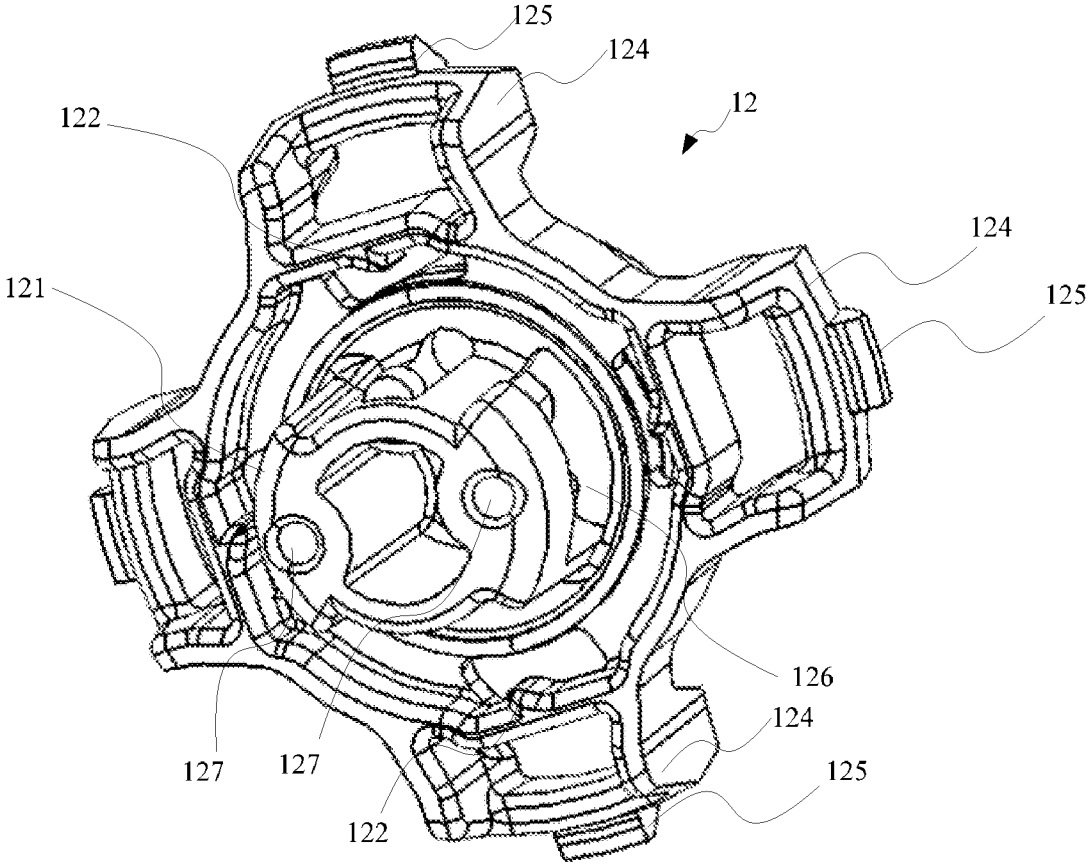
FIG. 3A and FIG. 3B are schematic diagrams of a support member from different views in an embodiment of the present disclosure.
Figure 3B:
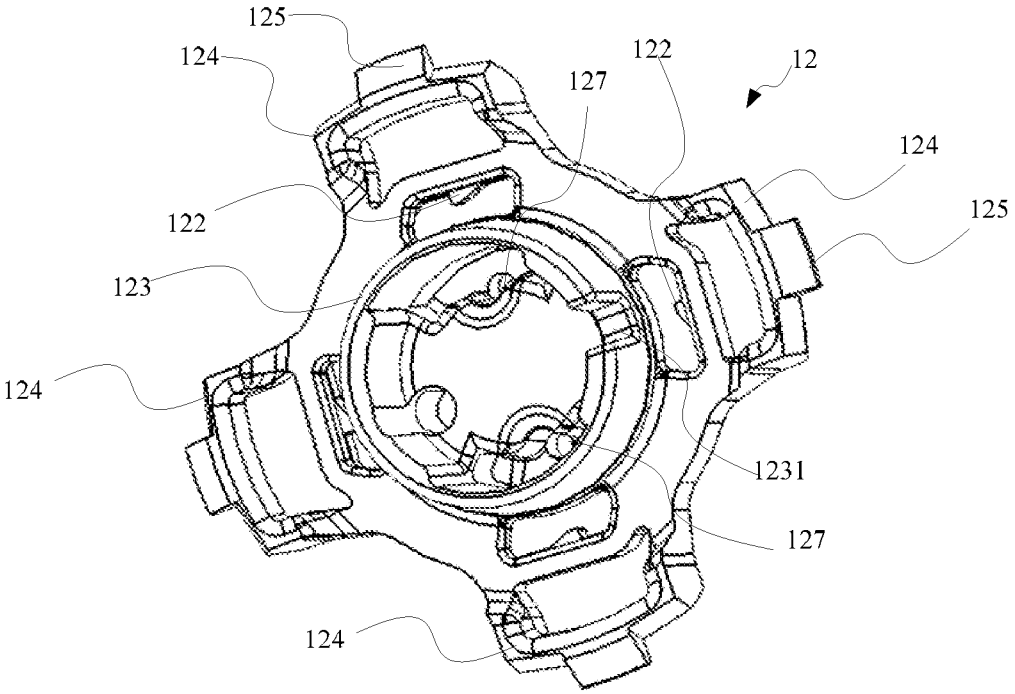
Figure 5A:
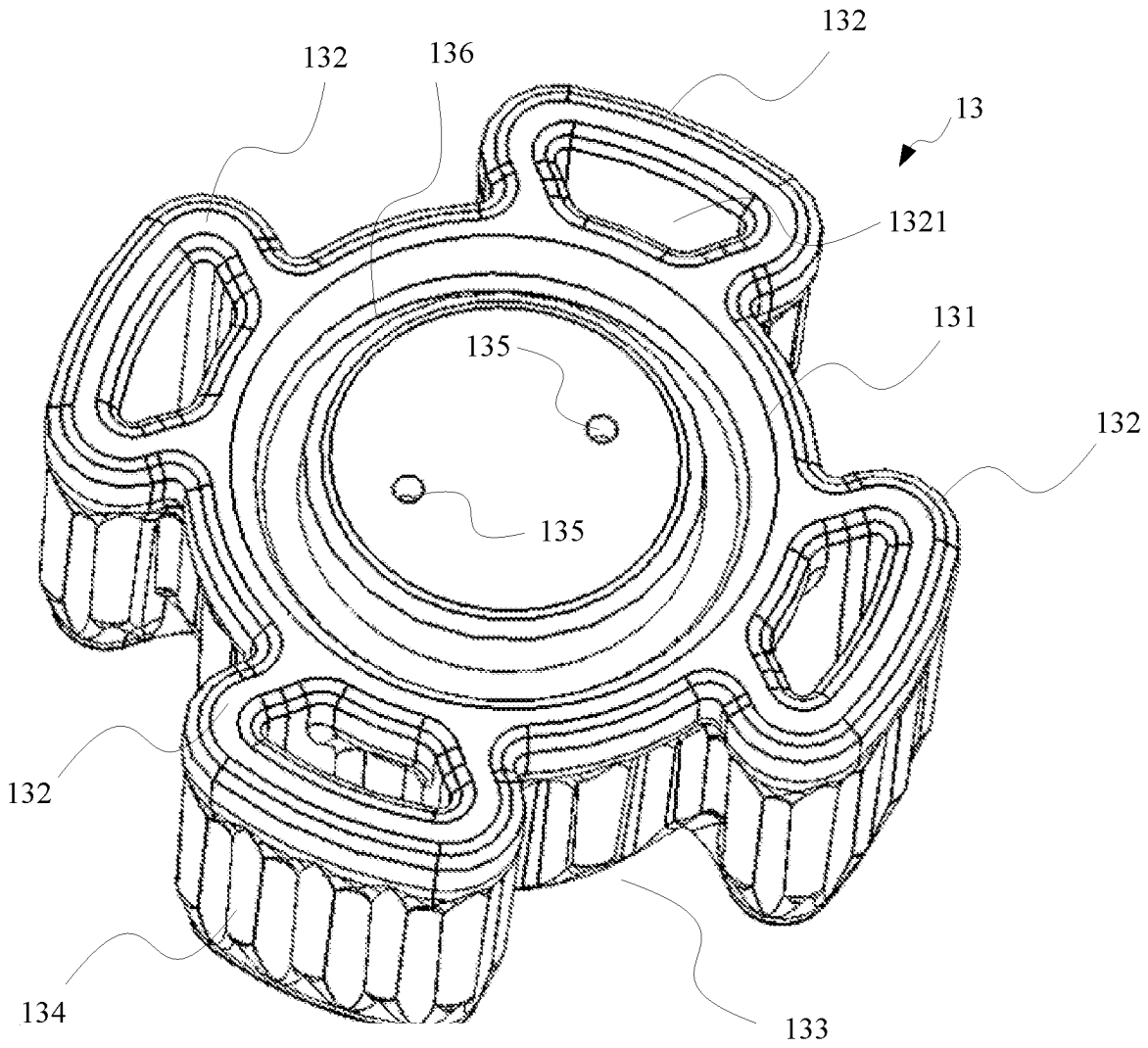
FIG. 5A and FIG. 5B are schematic diagrams of a light source mounting member from different views in an embodiment of the present disclosure.
Figure 5B:
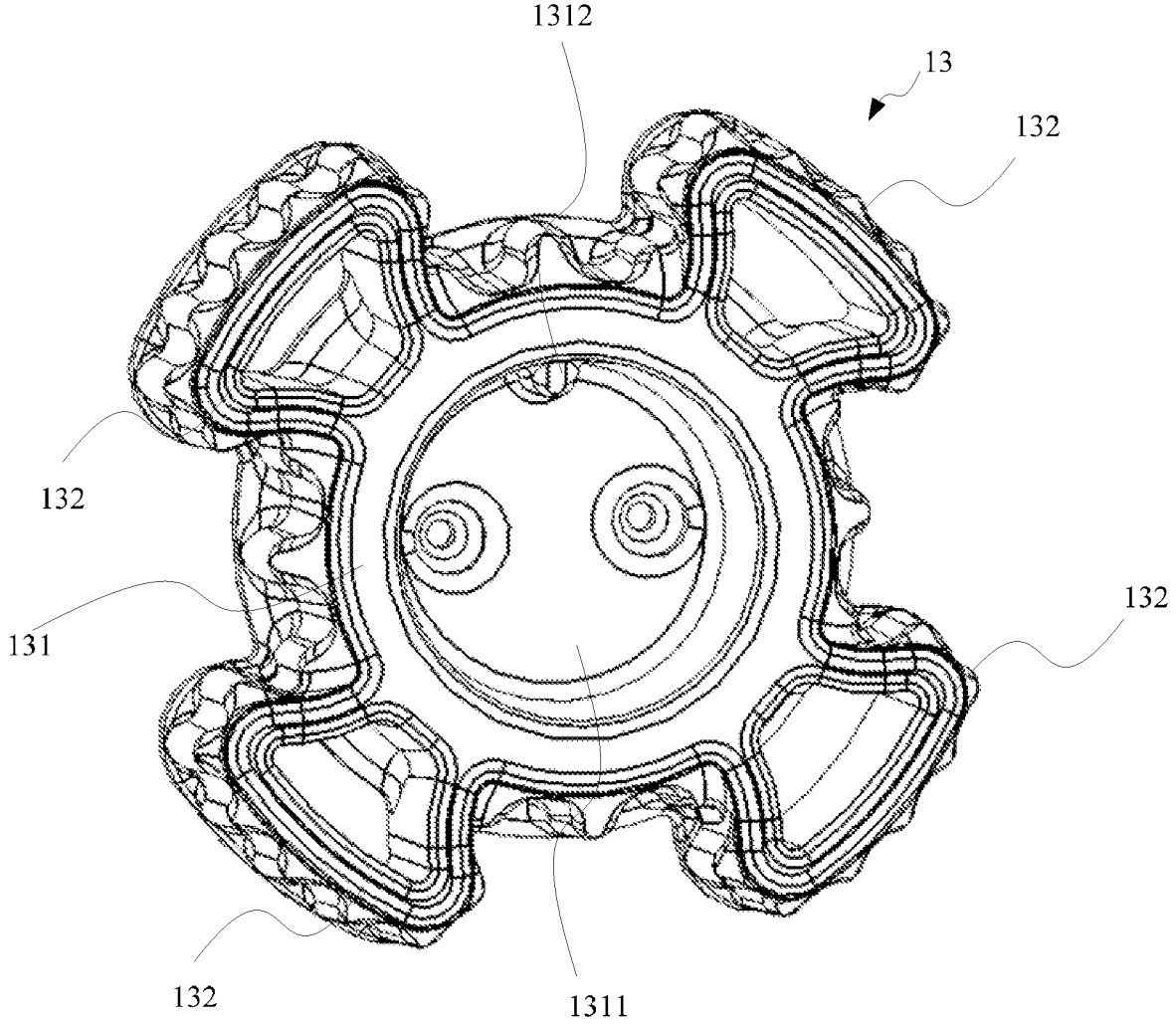

In this embodiment, with reference to FIG. 1B, FIG. 3B and FIG. 5B, it can be known that the support member 12 is provided with a first positioning portion 123 on one side, and the light source mounting member 13 is provided with a second positioning portion 1311, the second positioning portion 1311 is jointed with the first positioning portion 123 through shape matching, thereby connecting and transversely positioning the support member 12 and the light source mounting member 13. Moreover, as shown in FIG. 1B, FIG. 2A and FIG. 3A, the bearing member 11 is provided with a third positioning portion 111 on a side facing the support member 12. The support member 12 is provided with a fourth positioning portion 121 on a side away from the first positioning portion 123 (which is a side facing the bearing member 11 in this embodiment). The third positioning portion 111 is jointed with the fourth positioning portion 121 through shape matching, thereby connecting and transversely positioning the support member 12 and the bearing member 11.

Moreover, as shown in FIG. 1A, the support member 12 and the lens member 11 are connected in a positioned manner, so as to clamp and longitudinally position the light source mounting member 13 therebetween, thereby fixing the position of the light source mounting member 13. The positioning connection is a clamping connection in this embodiment, in other embodiments, the positioning connection may be an adhesion connection or other connections. The clamping connection can implement a detachable connection between the support member 12 and the lens member 11.

As shown in FIG. 1B, the light source module 100 further comprises a light source electronic component 15 (such as a light source chip) and an electrode component 16 for electrically connecting the light source electronic component 15 and a driving power source (not shown in the figure).

The bearing member 11 is provided with a third positioning portion 111. The support member 12 has a fourth positioning portion 121 jointed with the third positioning portion 111 through shape matching. The third positioning portion 111 may be one of a shaft hole and a shaft portion that can be jointed in a rotatable manner, and the fourth positioning portion 121 may be the other of the shaft hole and the shaft portion. In an embodiment, the third positioning portion 111 is a shaft hole, and the fourth positioning portion 121 is a shaft portion.

Figure 2B:
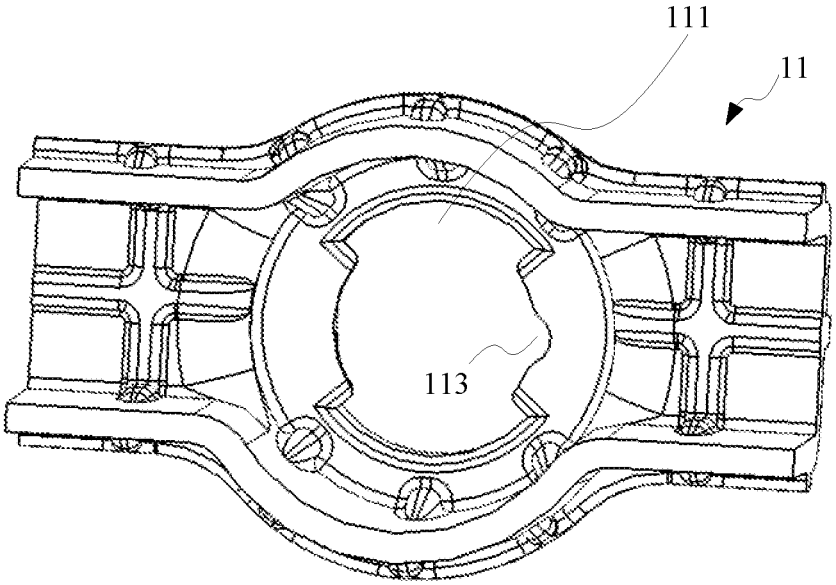

Refer to FIG. 2A and FIG. 2B. In FIG. 2A, the bearing member 11 is provided with a round hole along a longitudinal direction. An inner wall of the round hole is provided with one or more arc-shaped bosses (a pair of arc-shaped bosses in this embodiment) protruding inwards, to form the third positioning portion 111, that is, the shaft hole. In FIG. 2B, the shape of the shaft hole can be seen clearly. In addition, as shown in FIG. 3A, the shape of the fourth positioning portion 121, that is, the shaft portion, matches that of the shaft hole. The fourth positioning portion 121 can be adjusted to a position corresponding to the shape of the third positioning portion 111, so that the fourth positioning portion 121 can be inserted into the third positioning portion 111.

Moreover, as shown in the figure, cross sections of the third positioning portion 111 and the fourth positioning portion 121 may be symmetric, for example, axially symmetric or centrally symmetric. Alternatively, a concave-convex fitting structure may be formed between the third positioning portion 111 and the fourth positioning portion 121 to make the cross sections of the third positioning portion 111 and the fourth positioning portion 121 to be asymmetric, thereby preventing the bearing member 11 and the support member 12 from being reversely assembled, that is, achieving a fool-proofing function. For example, as shown in FIG. 2A, a notch 113 is formed on a side wall of the third positioning portion 111. Moreover, as shown in FIG. 3A, a side wall of the fourth positioning portion 121 is provided with a lug jointed with the notch 113 through shape matching. The notch 113 and the lug form the fool-proofing structure.

The bearing member 11 and the support member 12 are jointed and assembled with each other through the third positioning portion 111 and the fourth positioning portion 121, so that the bearing member 11 and the support member 12 can be secured to each other through structure design without using screws or tools.

As shown in FIG. 2A, the bearing member 11 is provided with one or more first rotation limiting portions 114 along the circumference of the third positioning portion 111. A guide structure 1141 and a barrier structure 1142 disposed along the circumference are formed on the surface of the first rotation limiting portion 114. The guide structure 1141 is used for guiding objects circumferentially; the objects are guided to move along the guide structure 1141 until reaching the barrier structure 1142.

In this embodiment, the first rotation limiting portion 114 is a lobe. A part of the outer surface of the lobe is an inclined surface that serves as the guide structure 1141; the other part of the outer surface is a vertical surface connected to the inclined surface and perpendicular to the circumference, and serves as the barrier structure 1142. An object can move along the inclined surface towards the vertical surface; when reaching a tail end of the inclined surface, the object falls to be opposite to the vertical surface. Therefore, the vertical surface will block the object if the object tends to rotate reversely, thereby limiting reverse rotation.

Correspondingly, as shown in FIG. 3A, it can be seen that the support member 12 is provided with second rotation limiting portions 122 located along the circumference of the fourth positioning portion 121, the second rotation limiting portions 122 each corresponds to one of the first rotation limiting portions respectively. The second rotation limiting portion 122 may be a lobe similar to the first rotation limiting portion 114, and an inclined surface of the second rotation limiting portion 122 is opposite to the inclined surface of the first rotation limiting portion 114. Vertical surfaces of the first rotation limiting portion 114 and the second rotation limiting portion 122 are disposed away from each other. The inclined surface of the first rotation limiting portion 114 moves along the inclined surface of the second rotation limiting portion 122, so that the vertical surfaces of the first rotation limiting portion 114 and the second rotation limiting portion 122 move closer to each other. Finally, the first rotation limiting portion 114 crosses the second rotation limiting portion 122, so that the vertical surfaces of the first rotation limiting portion 114 and the second rotation limiting portion 122 are disposed opposite to each other. The two planes perpendicular to the circumference abut against each other, thereby achieving a good effect of preventing reverse rotation.

Obviously, in other embodiments, the second rotation limiting portion 122 may be another protruding structure 132, such as a rib, a bump, or a boss, which is not limited to the embodiment shown in the figures. Moreover, the first rotation limiting portion 114 is not limited to the lobe. The guide structure 1141 and the barrier structure 1142 may be other structures. For example, the guide structure 1141 is a convex cambered surface, and the barrier structure 1142 may also be a concave cambered surface; or the first rotation limiting portion 114 may be a chamfer or the like, and is not limited to the structure shown in the figures.

Figure 4:
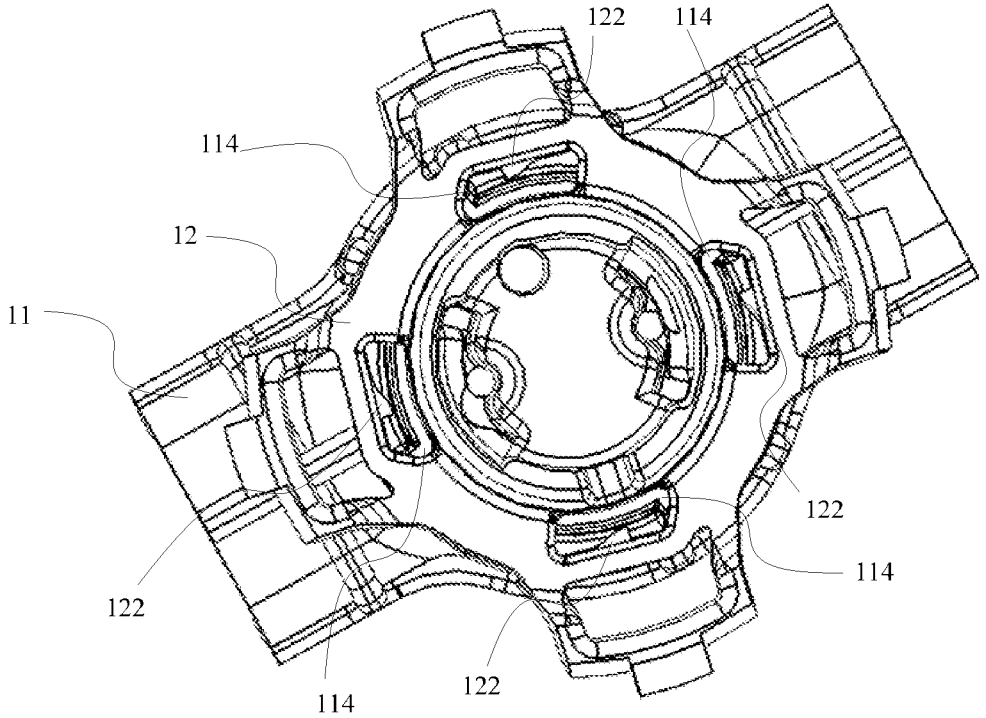
FIG. 4 is a schematic diagram of a bearing member and a support member that are in an assembled state in an embodiment of the present disclosure.

As shown in FIG. 4, the third positioning portion 111 is jointed with the fourth positioning portion 121. In this case, the first rotation limiting portion 114 and the second rotation limiting portion 122 are in the same plane. The third positioning portion 111 rotates with respect to the fourth positioning portion 121 (which is clockwise rotation in the figure), that is, the shaft portion rotates in the shaft hole, so that the second rotation limiting portion 122 moves along the guide structure 1141 of the corresponding first rotation limiting portion 114. Moreover, because the first rotation limiting portion 114 and the second rotation limiting portion 122 are located at a certain position on respective components, the second rotation limiting portion 122 extrudes the guide structure 1141 when moving along the guide structure 1141 of the first rotation limiting portion 114. The support member 12 may be made of a material with certain elastic deformability, for example, a plastic material. In this embodiment, the support member 12 is provided with a hollow, and the second rotation limiting portion 122 is disposed on an inner wall of the hollow. Due to the hollow, the part where the second rotation limiting portion 122 is located is thin and therefore has certain elastic deformability. When the second rotation limiting portion 122 moves along the guide structure 1141 of the first rotation limiting portion 114, the thin part is deformed under an extrusion force of the first rotation limiting portion 114, so that the first rotation limiting portion 114 can continue to move along the guide structure 1141, until the second rotation limiting portion 122 reaches the barrier structure 1142 of the first rotation limiting portion 114 and rotates reversely as blocked by the barrier structure 1142. As such, the support member 12 cannot rotate reversely with respect to the bearing member 11.

Definitely, it should be noted that in other embodiments, the elastic deformation may be implemented through a spring, an elastic strip or the like that connects the support member 12 and the second rotation limiting portion 122. In addition, other movement mechanisms may be used to make the first rotation limiting portion 114 or the second rotation limiting portion 122 capable of moving relatively, so as to achieve different relative positions between the first rotation limiting portion 114 and the second rotation limiting portion 122 in a guide state and a blocking state.

In an embodiment of the present disclosure, in order to limit forward rotation of the support member 12 when the support member 12 cannot rotate reversely with respect to the bearing member 11, as shown in FIG. 2A and FIG. 3A, the third positioning portion 111 is provided with a third rotation limiting portion 112 on the circumference of a lateral side, and the fourth positioning portion 121 is provided with a fourth rotation limiting portion 126 on the circumference of a lateral side. In FIG. 2A, the third positioning portion 111 is a shaft hole; the third rotation limiting portion 112 is the foregoing arc-shaped boss for forming the third positioning portion 111, and the fourth rotation limiting portion 126 is the open slot shown in FIG. 3A, where an opening side thereof faces the third rotation limiting portion 112. When the fourth positioning portion 121 rotates with respect to the third positioning portion 111, the third rotation limiting portion 112 enters from an opening end of the fourth rotation limiting portion 126 and is jointed with the fourth rotation limiting portion 126. When the second rotation limiting portion 122 reaches the barrier structure 1142 of the first rotation limiting portion 114, the third rotation limiting portion 112 abuts against a lateral edge surface of the fourth rotation limiting portion 126 to limit further rotating of the third positioning portion 111, so that the support member 12 can neither rotate reversely nor rotate forward, and therefore is fixed.

It should be noted that in other embodiments, the third rotation limiting portion 112 may be an open slot and the fourth rotation limiting portion may be a boss. This arrangement can also achieve the objective of limiting the forward rotation of the support member 12 with respect to the bearing member 11.

In addition, the bearing member 11 is not limited to the structure shown in the figure. In an embodiment, the bearing member 11 may be a strip structure with a plurality of third positioning portions 111 to be jointed with a plurality of fourth positioning portions 121 of the support member 12.

Referring to FIG. 3B, on a side facing the light source mounting member 13, the support member 12 is provided with a first positioning portion 123 and at least one first extension portion 124 disposed around the first positioning portion 123. Referring to FIG. 5A and FIG. 5B, the light source mounting member 13 has a second positioning portion 1311 jointed with the first positioning portion 123 through shape matching, and at least one limiting portion 133, each of the at least one limiting portion 133 is jointed with one of the at least one first extension portion 124. The joint between the first extension portion 124 and the limiting portion 133 can realize positioning of transverse movement and rotation of the light source mounting member 13. However, it should be noted that in other embodiments, the first extension portion 124 and the limiting portion 133 are not mandatory. For example, transverse positioning can be realized by merely jointing the first positioning portion 123 and the second positioning portion 1311, and rotation of the light source mounting member 13 may also be restricted by using a concave-convex fitting structure between the light source mounting member 13 and the support member 11 (the structure may be between the first positioning portion 123 and the second positioning portion 1311). This can achieve the same positioning effect for the light source mounting member 13 as the joint between the first extension portion 124 and the limiting portion 133.

In this embodiment, the first positioning portion 123 is a convex portion, and the second positioning portion 1311 is a concave portion. The first positioning portion 123 and the second positioning portion 1311 may be interchanged in other embodiments, and are not limited to this embodiment.

The first positioning portion 123 and the second positioning portion 1311 may be cylinder or other structures with symmetric cross section. Therefore, optionally, a concave-convex fitting structure that can change the symmetric shapes may be provided between the second positioning portion 1311 and the first positioning portion 123. For example, as shown in FIG. 5B, a boss 1312 is disposed in the second positioning portion 1311, that is, the concave portion; correspondingly, as shown in FIG. 3B, the first positioning portion 123 is provided with a notch 1231 that fits with the boss. The boss 1312 and the notch 1231 can achieve a fool proofing effect and a positioning effect (transverse movement positioning and rotation limitation in some directions).

As shown in FIG. 5A and FIG. 5B, in this embodiment, the light source mounting member 13 comprises: a main body 131 and at least two protruding structures 132. The second positioning portion 1311 is disposed on the main body 131. In other embodiments, the second positioning portion 1311 is not limited to dispose on the main body 131. The light source mounting member 131 may adopt other structures, as long as the second positioning portion 1311 can be implemented on the light source mounting member 131. The structure of the light source mounting member 131 is not limited to this embodiment.

The main body 131 is cylinder in this embodiment, or may be other shapes such as a cuboid. The main body 131 may be provided with the bearing surface for disposing the light source electronic component 15. Optionally, the bearing surface is a surface on the main body 131 and away from the bearing member 11. The bearing surface may vary according to actual requirements, and is not limited to this embodiment.

The number of the protruding structures 132 is four in this embodiment, the number may vary according to actual requirements. The protruding structures 132 are disposed at intervals along the circumference of the lateral side of the main body 131, and the limiting portion 133 is formed at the gap between the protruding structures 132. The limiting portion 133 is preferably open at both ends.

Optionally, the at least two protruding structures 132 each have a through portion 1321 serving as a cooling air flow passage. It can be seen from the figures that the through portion 1321 is perforated, thereby enhancing the cooling effect.

Figure 5C:
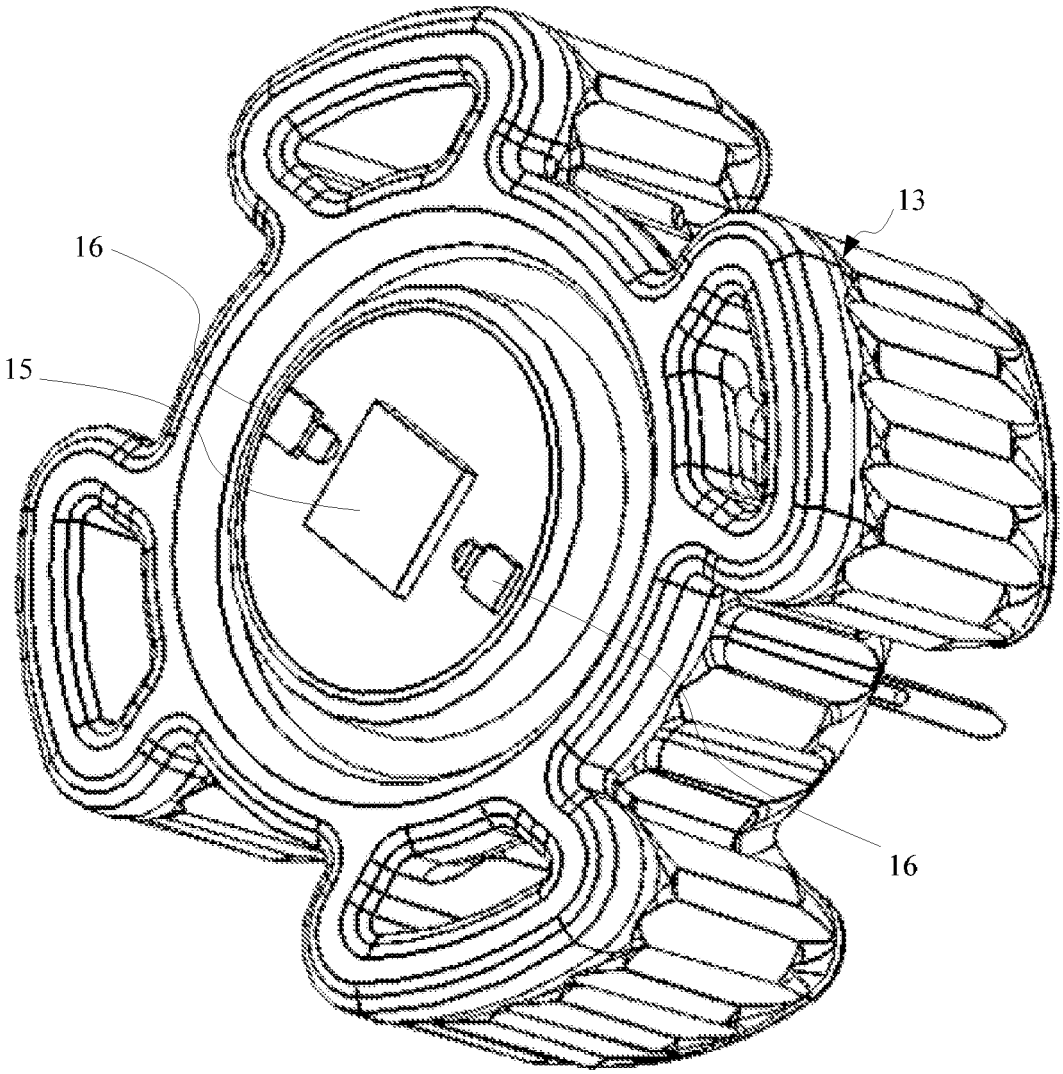
FIG. 5C is a schematic diagram of a light source mounting member equipped with a light source electronic component and an electrode component in an embodiment of the present disclosure.

As shown in FIG. 5A and FIG. 5C, the light source mounting member 13 has a bearing surface for disposing a light source electronic component 15 (such as an LED light source chip). The light source electronic component 15 is electrically connected to a power source. In this embodiment, the light source module 10 further comprises a pair of electrode components 16 (that is, positive and negative electrodes) with one end disposed on the bearing surface and electrically connected to the light source electronic component 15. The electrical connection may be achieved through wires or a printed metal circuit, the printed metal circuit is preferred. The metal circuit is printed on an insulator, if a metal circuit is printed on the light source mounting member 13 directly, the light source mounting member 13 should be made of an insulation material, which has good thermal conductivity, such as ceramic, so as to facilitate cooling of the light source electronic component 15. Or, the light source mounting member 13 may be made of aluminum; in this case, the light source electronic component 15 needs to be disposed on an insulator and then mounted on the light source mounting member 13. According to the design of the present disclosure, the light source mounting member 13 and the support member 11 are independent components. Therefore, the support member 11 does not need to take on many tasks such as cooling; the material of the support member 11 can be selected from a wide range. For example, the support member 11 can be made of a common plastic material.

The light source mounting member 13 is provided with a pair of first through-holes 135 on the bearing surface, so that the pair of electrode components 16 penetrates the pair of first through-holes 135, where the form after penetration is shown in FIG. 5C. Moreover, it can be seen from FIG. 3A that the support member 12 is also provided with a pair of second through-holes 127 penetrating the fourth positioning portion 121 and the first positioning portion 123, so that the pair of electrode components 16 penetrates the pair of second through-holes 127 and is exposed on a rear surface of the bearing member 11, to electrically connect to the driving power source of the lighting device.

Optionally, in order to further enhance the cooling effect, wrinkles 134 are formed on at least a part of the outer surface of the light source mounting member 13, thereby increasing the cooling area.

As shown in FIG. 3B, FIG. 5A and FIG. 5B, the first extension portion 124 is a convex body extending towards the light source mounting member 13. The limiting portion 133 is a groove formed on a circumferential surface of the light source mounting member 13, where an extension direction of the groove is the same as that of the convex body. In this embodiment, the direction away from the bearing member 11 is parallel to an axial direction of the mounting member. When the first extension portion 124 is jointed with the limiting portion 133, the light source mounting member 13 is positioned on the support member 12.

Although the first extension portion 124 is a convex body and the limiting portion 133 is a groove in this embodiment, the first extension portion 124 may be a groove and the limiting portion 133 may be a convex body in other embodiments.

Figure 6:
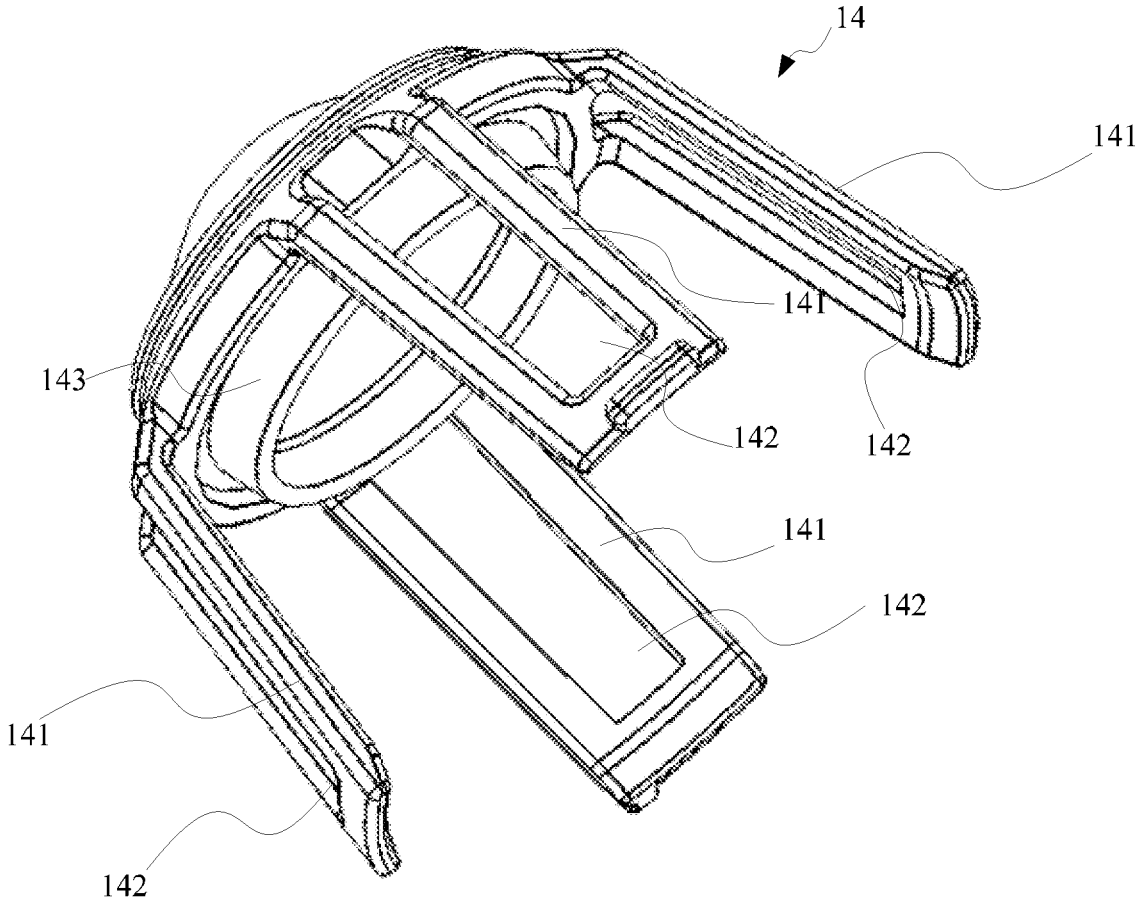
FIG. 6 is a schematic diagram of a lens member in an embodiment of the present disclosure.

As shown in FIG. 3B, the support member 12 is further provided with a first clamping portion 125. In this embodiment, the first clamping portion 125 is disposed on the first extension portion 124. In other embodiments, the first clamping portion 125 may be disposed on other parts of the support member 12, which is not limited this embodiment. Further, as shown in FIG. 6, the lens member 14 is used for perform light distribution by covering the light source electronic component 15. Moreover, the lens member 14 is provided with a second clamping portion 142 clamped with the first clamping portion 125. After the first clamping portion 125 and the second clamping portion 142 are clamped, the light source mounting member 13 is secured between the support member 12 and the lens member 14, as shown in FIG. 1A.

As shown in FIG. 1A and FIG. 5A, the limiting portion 133 may be a groove open at both ends. The lens member 14 may be further provided with a second extension portion 141 to be jointed with the limiting portion 133, and the second clamping portion 142 is disposed on the second extension portion 141. The first extension portion 124 and the second extension portion 141 are each jointed with part of the limiting portion 133. For example, in this embodiment, the first extension portion 124 enters the limiting portion 133 from a lower end, and the second extension portion 141 enters the limiting portion 133 from an upper end, so that relative positions of the lens member 14, the light source mounting member 13 and the support member 12 are all fixed transversely; in addition, the lens member 14, the light source mounting member 13 and the support member 12 are longitudinally positioned by means of the clamping between the first clamping portion 125 and the second clamping portion 142, thereby having a fixed relative position relationship.

The first clamping portion 125 is one of a hook portion and a buckle portion clamped with the hook portion, and the second clamping portion 142 is the other one of the hook portion and the buckle portion. In this embodiment, the first clamping portion 125 is a hook portion, the second clamping portion 142 is a buckle portion.

Moreover, in the embodiment shown in FIG. 1A to FIG. 6, the first clamping portion 125 is a hook portion located on the circumference of the support member 12 and protruding outwards, and the second clamping portion 142 is clamped with the first clamping portion 125 from an external side of the first clamping portion 125.

Figure 7:
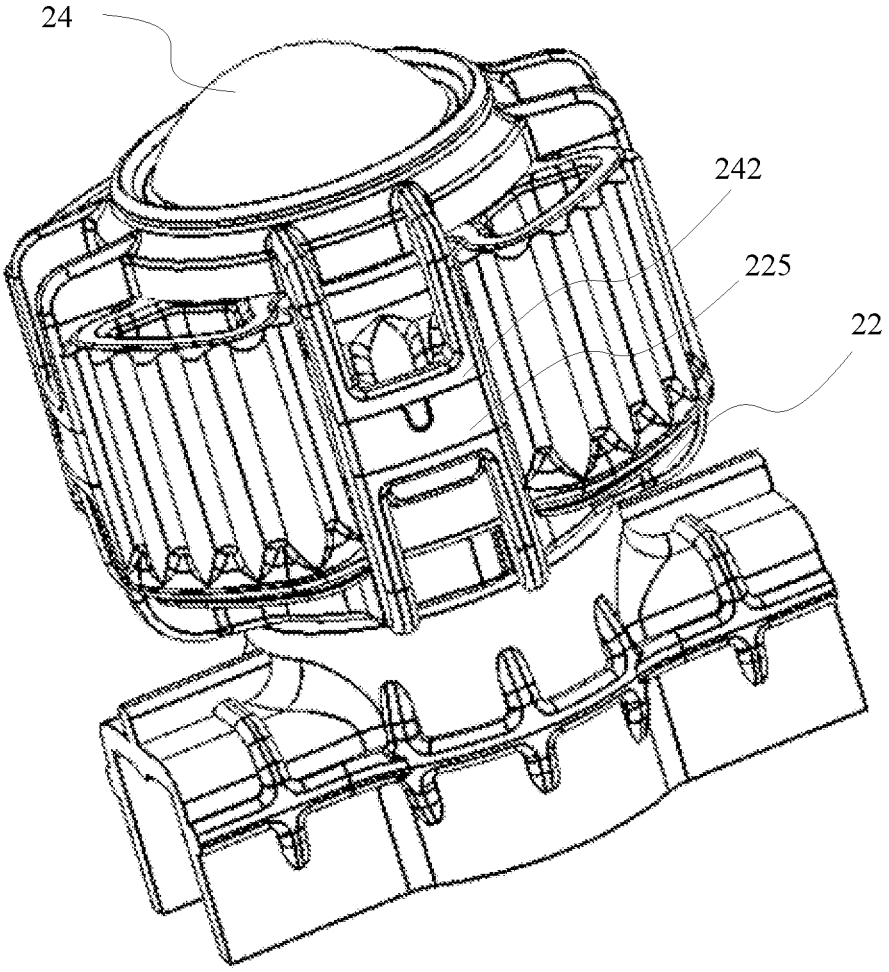
FIG. 7 is an assembled schematic diagram of a light source module in another embodiment of the present disclosure.
Figure 8:
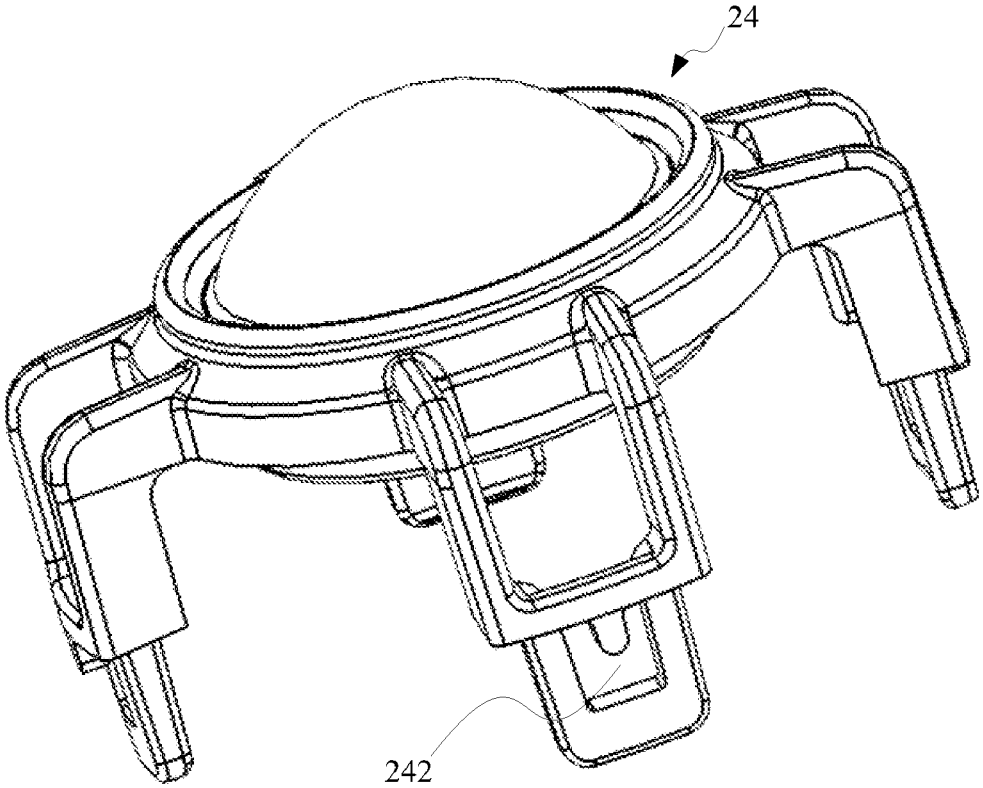
FIG. 8 is a schematic diagram of a lens member in another embodiment of the present disclosure.
Figure 9:
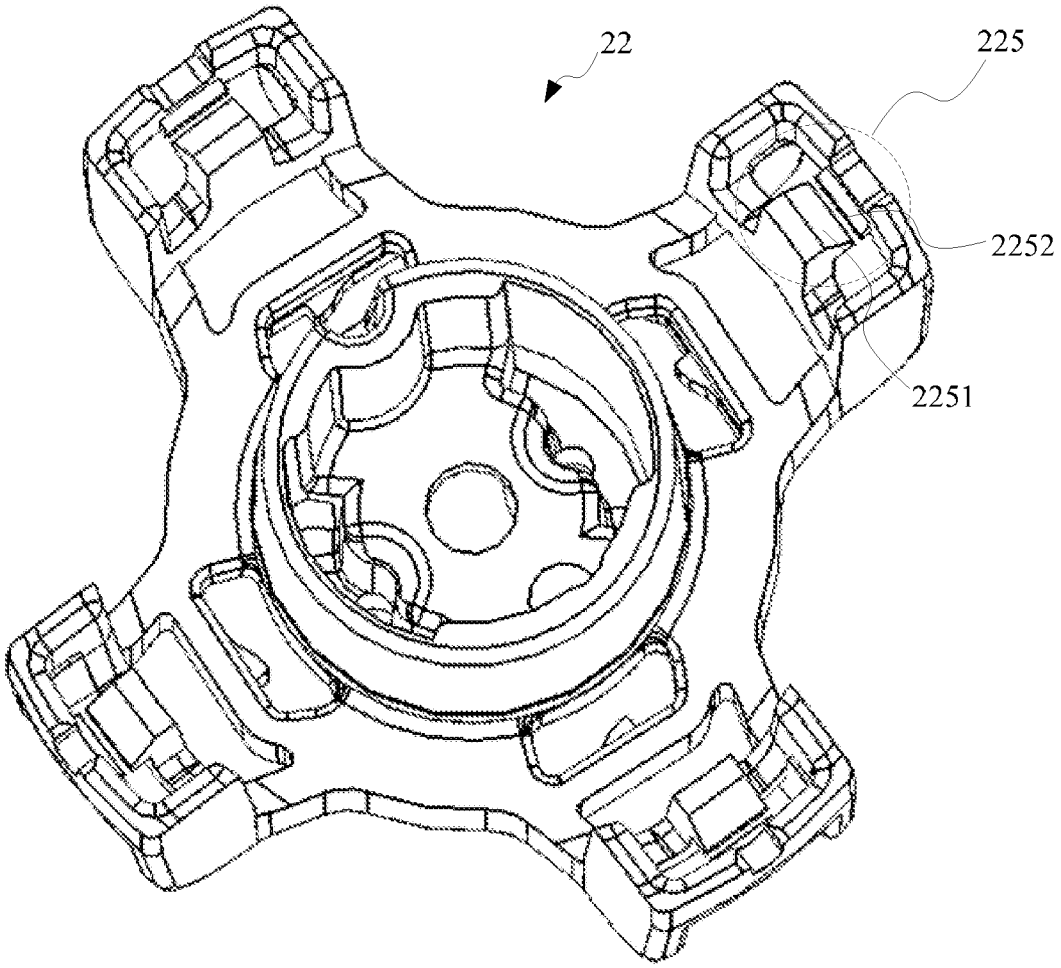
FIG. 9 is a schematic diagram of a support member in another embodiment of the present disclosure.

In order to prevent the first clamping portion and the second clamping portion from slipping, the clamping structure may be changed in other embodiments. For example, FIG. 7 to FIG. 9 show implementation of the first clamping portion 225 and the second clamping portion 242 in another embodiment. In this embodiment, the first clamping portion 225 comprises a hook portion 2251 located on the circumference of the support member 22 and protruding inwards, and a stopping portion 2252 disposed opposite to the hook portion 2251. A gap is formed between the hook portion 2251 and the stopping portion 2252, so that the buckle portion is inserted in the gap and clamped with the hook portion 2251. Optionally, the hook portion 2251 has a guide surface (such as an inclined surface or a cambered surface) inclined towards the interior of the gap. The stopping portion 2252 or the hook portion 2251 may be elastic deformable or is flexible so that the gap has an adjustable width. The opening of the gap may be adjusted to be wide enough to allow the second clamping portion 242 of the lens member 24 to enter (for example, the guide surface of the hook portion 2251 is extruded to be elastically deformed, thereby expanding the opening of the gap). The width of the gap is reduced to be less than the width of the second clamping portion 242 after the second clamping portion 242 enters, so as to limit the second clamping portion 242 within the gap.

In order to provide seal protection for the light source electronic component 15, as shown in FIG. 5C, the bearing surface is provided with an annular groove 136 around the light source electronic component 15. Besides, as shown in FIG. 6, the lens member 14 has an annular flange 143 jointed with the annular groove 136, so as to form, together with the bearing surface, a closed space for containing the light source electronic component 15. A sealant is disposed in the annular groove 136 to seal the closed space. The sealant may be a sealing gel capable of rapid solidification. The sealing gel is mounted on the lens member 14 before being solidified, so that the annular flange 143 is placed into the annular groove 136. The closed space is sealed after the sealing gel is solidified.

In conclusion, the present disclosure provides a light source module and a lighting device using the same. The light source module comprises: a support member, to be disposed on a lighting device and provided with a first positioning portion; a light source mounting member, having a second positioning portion to be jointed with the first positioning portion through shape matching, where the light source mounting member has a bearing surface for disposing a light source electronic component; and a lens member, covering the bearing surface and connected to the support member in a positioned manner. The light source of each lighting device includes one or more light source modules according to the present disclosure, and each light source module is an independent component that is easy to replace, thereby resolving problems in the prior art. Moreover, the support member and the light source mounting member are independent components; the support member and the light source mounting member may be made of different materials, thereby reducing costs.

The present invention effectively overcomes various disadvantages in the prior art and hence has high industrial use value.

The foregoing embodiments are only to illustrate the principle and efficacy of the present invention exemplarily, and are not to limit the present invention. Any person skilled in the art can make modifications or variations on the foregoing embodiments without departing from the spirit and scope of the present invention. Accordingly, all equivalent modifications or variations completed by those with ordinary skill in the art without departing from the spirit and technical thinking disclosed by the present invention should fall within the scope of the claims of the present invention.

What is claimed is:

1. A light source module, comprising:

a support member, disposed on a lighting device and provided with a first positioning portion;

a light source mounting member, provided with a second positioning portion jointed with the first positioning portion through shape matching, wherein the light source mounting member has a bearing surface for disposing a light source electronic component; and a lens member, covering the bearing surface and connected to the support member by a positioning connection;

wherein the positioning connection is a clamping connection; the support member is provided with a first clamping portion; and the lens member is provided with a second clamping portion clamped with the first clamping portion;

wherein the first clamping portion is one of a hook portion and a buckle portion clamped with the hook portion, and the second clamping portion is the other one of the hook portion and the buckle portion.

2. The light source module according to claim 1, comprising: at least one pair of electrode components, wherein one end of electrode component is electrically connected to the light source electronic component, and the other end passes through the support member and the light source mounting member to be exposed.

3. The light source module according to claim 2, wherein the electrode component and the light source electronic component are connected through a printed circuit.

4. The light source module according to claim 1, wherein the light source mounting member is made of ceramic.

5. The light source module according to claim 1, wherein at least part surface of the light source mounting member is wrinkled.

6. The light source module according to claim 1, wherein the bearing surface is provided with an annular groove around the light source electronic component; the lens member has an annular flange jointed with the annular groove, so as to form, together with the bearing surface, a closed space for containing the light source electronic component; and a sealant is disposed in the annular groove to seal the closed space.

7. The light source module according to claim 1, wherein the support member is provided with at least one first extension portion around the first positioning portion, the at least one first extension portion extending towards the lens member, and the light source mounting member is provided with at least one limiting portion, the at least one limiting portion each is jointed with one of the at least one first extension portion correspondingly.

8. The light source module according to claim 7, wherein the first extension portion is a convex body extending towards the lens member, and the limiting portion is a groove located on an outer surface of the light source mounting member and fitting with the convex body.

9. The light source module according to claim 7, wherein the light source mounting member comprises:

a main body; and at least two protruding structures disposed with spacing along the circumference of a lateral side of the main body, wherein the limiting portion is formed at a gap between the protruding structures.

10. The light source module according to claim 9, wherein the at least two protruding structures each has a through portion serving as a cooling air flow passage.

11. The light source module according to claim 7, wherein the lens member is provided with a second extension portion jointed with the limiting portion, the first extension portion and the second extension portion are each jointed with a part of the limiting portion.

12. The light source module according to claim 11, wherein the first clamping portion is disposed at the first extension portion, the second clamping portion is disposed at the second extension portion.

13. The light source module according to claim 1, wherein clamping between the first clamping portion and the second clamping portion is either of the following:

1) the first clamping portion is a hook portion located on the circumference of the support member and protruding outwards to clamp with the second clamping portion on an external side thereof; and 2) the first clamping portion comprises a hook portion located on the circumference of the support member and protruding inwards, and a stopping portion disposed opposite to the hook portion, wherein a gap is formed between the hook portion and the stopping portion to allow the buckle portion to insert and clamp with the hook portion; and the gap has an adjustable width to limit the buckle portion within the gap.

14. The light source module according to claim 1, wherein a concave-convex fitting structure is formed between the first positioning portion and the second positioning portion.

15. A lighting device, comprising one or more light source modules according to claim 1.

16. The lighting device according to claim 15, comprising a bearing member, wherein the support member is provided with a third positioning portion; and the bearing member is provided with a fourth positioning portion jointed with the third positioning portion through shape matching.

17. The lighting device according to claim 16, wherein the third positioning portion is one of a shaft hole and a shaft portion that can be jointed in a rotatable manner, and the fourth positioning portion is the other one of the shaft hole and the shaft portion; the bearing member is provided with one or more first rotation limiting portions along the circumference of the third positioning portion; a guide structure and a barrier structure disposed along the circumference of the first rotation limiting portion are formed on the surface of the first rotation limiting portion; the support member is provided with one or more second rotation limiting portions around the circumference of the fourth positioning portion, wherein the one or more second rotation limiting portions each corresponds to each of the one or more first rotation limiting portions; when the third positioning portion is jointed with the fourth positioning portion, rotation of the third positioning portion with respect to the fourth positioning portion causes the second rotation limiting portion to move along the guide structure of the corresponding first rotation limiting portion, until the second rotation limiting portion reaches the barrier structure of the first rotation limiting portion, blocked by the barrier structure, and rotates reversely.

18. The lighting device according to claim 17, wherein the first rotation limiting portion is a lobe, and the second rotation limiting portion is a convex portion.

19. The lighting device according to claim 17, wherein the third positioning portion is provided with a third rotation limiting portion on the circumference of a lateral side, and the fourth positioning portion is provided with a fourth rotation limiting portion on the circumference of a lateral side; when the second rotation limiting portion reaches the barrier structure of the first rotation limiting portion, the third rotation limiting portion is blocked by the fourth rotation limiting portion, so that further rotation of the third positioning portion is restricted.

20. The lighting device according to claim 19, wherein the third rotation limiting portion is a convex portion, the fourth rotation limiting portion is an open slot open towards the convex portion, and edges of the open slot are used to block the third rotation limiting portion.

21. The lighting device according to claim 15, wherein a concave-convex fitting is formed between the third positioning portion and the fourth positioning portion.

* * * * *